US009763492B2

(12) United States Patent
Polegato Moretti

(10) Patent No.: US 9,763,492 B2
(45) Date of Patent: Sep. 19, 2017

(54) WATERPROOF AND VAPOR-PERMEABLE SHOE, PARTICULARLY BUT NOT EXCLUSIVELY OF THE SAFETY TYPE OR THE LIKE

(71) Applicant: GEOX S.P.A., Montebelluna, Localita Biadene-(Treviso) (IT)

(72) Inventor: Mario Polegato Moretti, Crocetta Del Montello (IT)

(73) Assignee: GEOX S.P.A., Montebelluna, Localita Biadene-(Treviso) (IT)

( * ) Notice: Subject to any disclaimer, the term of this patent is extended or adjusted under 35 U.S.C. 154(b) by 160 days.

(21) Appl. No.: 14/365,778

(22) PCT Filed: Nov. 13, 2012

(86) PCT No.: PCT/EP2012/072494

§ 371 (c)(1),
(2) Date: Jun. 16, 2014

(87) PCT Pub. No.: WO2013/087324

PCT Pub. Date: Jun. 20, 2013

(65) Prior Publication Data

US 2015/0113836 A1 Apr. 30, 2015

(30) Foreign Application Priority Data

Dec. 16, 2011 (IT) ..... PD2011A0395

(51) Int. Cl.
*A43B 7/06* (2006.01)
*A43B 7/12* (2006.01)
(Continued)

(52) U.S. Cl.
CPC ..... *A43B 7/125* (2013.01); *A43B 1/04* (2013.01); *A43B 7/06* (2013.01); *A43B 7/085* (2013.01); *A43B 9/12* (2013.01)

(58) Field of Classification Search
CPC .. A43B 7/085; A43B 7/08; A43B 7/12; A43B 7/087; A43B 7/082; A43B 1/04;
(Continued)

(56) References Cited

U.S. PATENT DOCUMENTS

2003/0070323 A1* 4/2003 Johnson, Jr. ..... A43B 7/32 36/77 R
2004/0049942 A1* 3/2004 Chen ..... A43B 7/125 36/3 A
(Continued)

FOREIGN PATENT DOCUMENTS

CN 101674742 A 3/2010
IT WO 2011098344 A1 * 8/2011 ..... A43B 7/08
(Continued)

OTHER PUBLICATIONS

Combined Chinese Office Action and Search Report issued Jul. 20, 2015 in Patent Application No. 201280067096.2 (with English Translation).
(Continued)

*Primary Examiner* — Clinton T Ostrup
*Assistant Examiner* — Jillian K Pierorazio
(74) *Attorney, Agent, or Firm* — Oblon, McClelland, Maier & Neustadt, L.L.P.

(57) ABSTRACT

A waterproof and vapor-permeable shoe, including: an upper assembly, which is composed of at least one upper and a waterproof and vapor-permeable functional layer internal thereto, a tread portion joined to the upper assembly below the upper assembly, at least one vapor permeation layer provided below the foot insertion space formed inside the shoe. At least one opening is provided lateral with respect to the shoe proximate to a region of connection of the upper assembly to the tread portion, the at least one opening being open toward a perimetric edge of the at least one vapor
(Continued)

permeation layer. The shoe further includes, interposed between the perimetric edge and the at least one opening, selectively: at least one waterproof and vapor-permeable functional element, at least one functional portion of the functional layer.

27 Claims, 8 Drawing Sheets

(51) Int. Cl.
*A43B 7/08* (2006.01)
*A43B 9/12* (2006.01)
*A43B 1/04* (2006.01)

(58) Field of Classification Search
CPC ..... A43B 23/07; A43B 23/022; A43B 7/125; A43B 7/06; A43B 9/12
USPC ..... 36/3 B, 3 A, 3 R, 30 R, 55, 12, 25 R
See application file for complete search history.

(56) References Cited

U.S. PATENT DOCUMENTS

2005/0160622 A1 7/2005 Chen
2006/0277787 A1* 12/2006 Vattes ..... A43B 17/08 36/3 A
2007/0294920 A1* 12/2007 Baychar ..... A43B 3/0084 36/113
2009/0293306 A1* 12/2009 Sedelmeier ..... A43B 7/081 36/88
2010/0011624 A1* 1/2010 Polegato Moretti ... A43B 7/125 36/3 A
2011/0162239 A1 7/2011 Bier et al.
2011/0167677 A1* 7/2011 Peikert ..... A43B 1/04 36/3 B
2011/0252667 A1* 10/2011 Polegato Moretti ..... A43B 7/08 36/98
2012/0151805 A1* 6/2012 Polegato Moretti ..... A43B 7/06 36/25 R
2012/0151806 A1* 6/2012 Polegato Moretti ..... A43B 7/06 36/3 B
2012/0297644 A1* 11/2012 Polegato Moretti ..... A43B 7/08 36/84

FOREIGN PATENT DOCUMENTS

TW 200416005 A 9/2004
TW 200913920 A 4/2009
TW 201110893 A1 4/2011
TW 201110894 A1 4/2011
TW 201141409 A1 12/2011

OTHER PUBLICATIONS

Georgian Examination Report issued Jun. 27, 2016 in Patent Application No. AP 2012 013523 (with English language translation).
Combined Taiwanese Office Action and Search Report issued Feb. 17, 2016 in Patent Application No. 101147672 (with English language translation).
International Search Report Issued Feb. 5, 2013 in PCT/EP12/072494 filed Nov. 13, 2012.
Italian Search Report Issued Sep. 24, 2012 in Italian Application No. PD2011A000395 filed Dec. 16, 2011.
Written Opinion of the International Searching Authority Issued Feb. 5, 2013 in PCT/EP12/072494 filed Nov. 13, 2012.

* cited by examiner

WATERPROOF AND VAPOR-PERMEABLE SHOE, PARTICULARLY BUT NOT EXCLUSIVELY OF THE SAFETY TYPE OR THE LIKE

The present invention relates to a waterproof and vapor-permeable shoe.

Such shoe is particularly but not exclusively of the safety type, or the like.

It is known that a shoe, in order to be comfortable, must ensure a correct exchange of heat and water vapor between the inner microclimate and the external environment.

In the field of providing waterproof shoes, the need is strongly felt to identify structures that are increasingly efficient and reliable in allowing the heat exchange and vapor permeation of the shoe, safeguarding its impermeability to water in the liquid state.

In particular, the waterproof and vapor-permeable shoes currently mainly commercially available are adapted to allow vapor permeation through the upper and through the sole.

As regards the upper, shoes are commercially available which have linings made of vapor-permeable material that is impermeable to water in the liquid state.

Some models of known shoes have a portion of the upper lined or replaced by materials that are simultaneously waterproof and vapor-permeable.

Vapor-permeability of the upper alone, however, does not allow a dissipation of the perspiration that forms inside the shoe that is sufficient to ensure a satisfactory comfort to the user, because most of the sweat glands that are present in the foot are distributed on the sole of the foot, which is covered by the footbed or insole of the shoe.

Thus, the perspiration produced in the sole of the foot does not evaporate easily, causing the unpleasant feeling of dampness or wetness.

This occurs even in open shoes, such as sandals, which cover only minimally the lateral and upper part of the foot.

For this reason, shoes are known which are provided with soles that have layers of waterproof and vapor-permeable materials optionally associated with protective layers and with fillers, capable as a whole of allowing an effective outflow of the perspiration through the region of the shoe occupied by the sole of the foot.

In this case, generally, the soles of these shoes are made of vapor-permeable material, for example leather, as in EP0619959 and EP0080710.

As an alternative, they have soles provided with holes or openings that pass through their thickness, as in EP0858270 and EP1545253.

Channels can also be provided substantially parallel to the resting arrangement of the sole of the foot in the shoe, through which the vapor can exit laterally with respect to the tread layer, as in EP1089642 and EP1185183.

These shoes indeed consist of an appreciable solution to the problem of vapor permeation and thermal dispersion at the sole of the foot, but they still suffer some marginal drawbacks.

In particular, if one does not intend to work on the structure of the sole, in order to avoid encountering constructive and economic complications that can be found both if openings are provided through the thickness and in the case of transverse openings, to be provided in the polymeric material of the sole, and are also due to the difficult insertion of the fragile waterproof and vapor-permeable layers in the sole, then it is advantageous to insert a portion of the sole inside the upper and modify the structure of the shoe so as to allow the outflow of the perspiration, that arrives from the region arranged below the sole of the foot, through the lower edge of the upper that is nearest to the ground and is protected by a tread layer.

Moreover, shoe constructions are currently known which are disclosed in WO2009/149886 and WO2009/149887.

These constructions have substantially an upper that has a plurality of lateral openings provided on the lower edge adjacent to the tread layer.

The waterproofness of the foot insertion seat is provided by a waterproof and vapor-permeable lining, closed like a sock, that lines completely the inside of the shoe.

An air-permeable vapor permeation layer is arranged below the assembly insole and above the tread layer, which is waterproof.

This vapor permeation layer, made of three-dimensional fabric, allows the water vapor to pass through it in a perpendicular direction with respect to the sole of the foot of the user to then flow out, in a direction that is substantially parallel thereto, toward the lateral openings to which the edges of the vapor permeation layer face.

Such a structure, though preventing infiltrations of water inside the sock-shaped lining, has the disadvantage that water can seep through the lateral openings of the upper and soak the vapor permeation layer, as well as the assembly insole and any other optional filling layers arranged externally to the sock-shaped lining.

The water, which thus impregnates the vapor permeation layer and the other layers that are lower than the waterproof sock, tends to stagnate, generating a plurality of negative drawbacks.

In particular, the stagnant water compromises the capacity of vapor permeation through the vapor permeation layer that it impregnates.

Moreover, the stagnant water, by evaporating, absorbs heat and generates a cooling of the sole of the foot of the user, compromising the comfort of the shoe, particularly during cold seasons, which generally correspond to the ones during which there is greater rainfall and therefore risk of infiltration of water during use of the shoes.

Moreover, the water that impregnates the vapor permeation layer and optionally also other layers outside the waterproof lining increases the weight of the shoe, making its use more tiring, particularly if the user uses it for long periods of time.

Moreover, the vapor permeation layer and possibly the other layers outside the waterproof lining, cyclically impregnated with water during the life of the shoe, tend to be a preferential site for the proliferation of unhealthy bacterial cultures capable of compromising the efficiency of the shoe.

Moreover, the shoe materials impregnated with water, comprised between the lining and the tread layer, which are waterproof, tend to remain wet or damp for a long time, drying slowly, and therefore degrade rapidly.

Moreover, without suitable protection, dirty water and dust can obstruct the openings of the upper and the vapor permeation layer, fatally inhibiting its vapor permeation functionality.

The aim of the present invention is to provide a shoe that allows to overcome the limitations and drawbacks of currently known shoes, particularly allowing to avoid the impregnation of the vapor permeation layer, while maintaining an efficient capacity for vapor permeation through it.

Within this aim, an object of the invention is to devise a shoe that allows to avoid the impregnation of the vapor permeation layer with water that arrives from outside of the shoe while allowing to have a soft and flexible vapor permeation layer that does not stiffen the structure of the shoe.

Another object of the invention is to devise a shoe that is structurally simple and easy to use and can be manufactured at a low cost.

This aim and these and other objects that will become better apparent hereinafter are achieved by a waterproof and vapor-permeable shoe, particularly but not exclusively of the safety type, or the like, comprising

- an upper assembly, which is composed of at least one upper and a waterproof and vapor-permeable functional layer which is internal thereto,
- a tread portion made of waterproof material, which is joined to said upper assembly below it,
- at least one vapor permeation layer provided below the foot insertion space defined inside said shoe to accommodate the foot of the user, at least one opening being provided which is lateral with respect to said shoe proximate to the region of connection of said upper assembly to said tread portion, said at least one opening being open toward the perimetric edge of said at least one vapor permeation layer, said shoe being characterized in that it has, interposed between said perimetric edge and said at least one opening so as to prevent the access to said at least one vapor permeation layer of water that arrives from said at least one opening selectively
- at least one waterproof and vapor-permeable functional element,
- at least one functional portion of said functional layer, said at least one vapor permeation layer being made of a vapor-permeable material selected from fibrous, porous or microporous materials.

Further characteristics and advantages of the invention will become better apparent from the description of preferred but not exclusive embodiments of the shoe according to the invention, illustrated by way of non-limiting example in the accompanying drawings, wherein:

FIG. 1 is an enlarged-scale sectional perspective view of a detail of a shoe according to the invention;

FIG. 2*a* is a perspective view of a component of a shoe according to the invention;

FIGS. 2*b*, 2*c* and 2*d* are enlarged-scale perspective views of details of alternative embodiments of the component, shown in FIG. 2*a*, of a shoe according to the invention;

Figure 1:
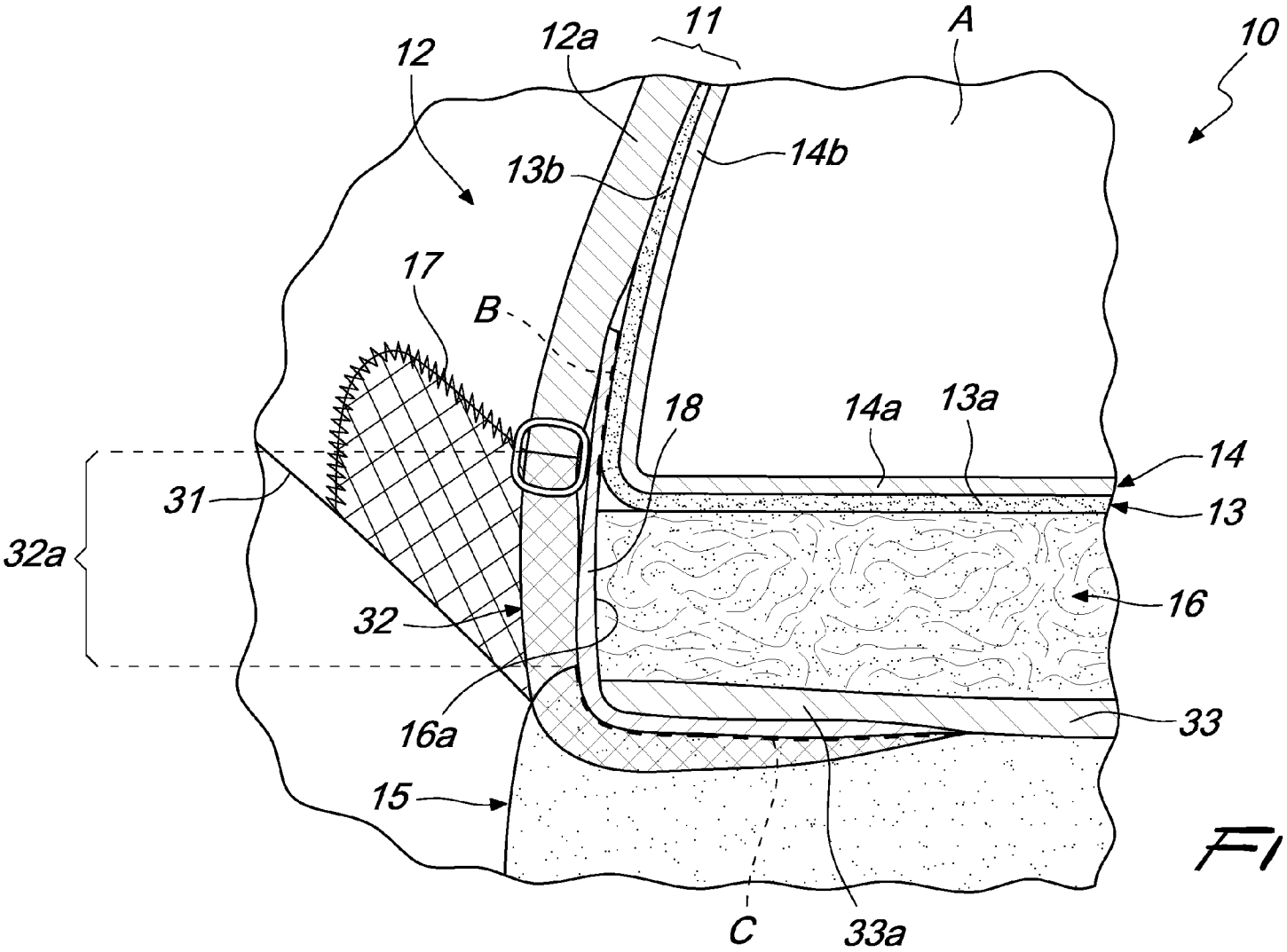

With reference to the figures, the reference numeral 10 generally designates a waterproof and vapor-permeable shoe, particularly but not exclusively of the safety type, or the like, comprising

- an upper assembly 11, which is composed of an upper 12, conveniently vapor-permeable or perforated, a waterproof and vapor-permeable functional layer 13, which is internal thereto, and conveniently also an inner lining 14,
- a tread portion 15 made of waterproof material, which is joined to the upper assembly 11 below it,
- a vapor permeation layer 16, provided below the foot insertion space A defined inside the shoe 10 to accommodate the foot of the user.

Openings 17 are provided, which are lateral with respect to the shoe 10, proximate to the region of connection of the upper assembly 11 to the tread portion 15, the openings 17 being open toward the perimetric edge 16*a* of the vapor permeation layer 16.

According to the invention, the shoe 10 has a particularity in that it comprises at least one waterproof and vapor-permeable functional element 18, which is interposed between the perimetric edge 16*a* and the openings 17 so as to prevent the access to the vapor permeation layer 16 of water that arrives from the openings 17.

The functional element 18 surrounds all of the perimetric edge 16*a* of the vapor permeation layer 16.

The tread portion 15 is sealed to the functional layer 13 by means of a sealing bridge, which is waterproof and vapor-permeable at least at the openings 17, and is provided by the functional element 18, which is sealed to them.

The vapor permeation layer 16 according to the invention is made of a vapor-permeable material, which is selected from fibrous, porous or microporous materials; in this manner, in particular, the vapor permeation layer advantageously is sufficiently resistant to compression to bear the weight of the user and allow the circulation of the vapor without hindering the deformation of the shoe 10 during its use, to the full benefit of user comfort.

Preferably, said vapor-permeable material is a three-dimensional fabric that has

- an upper hydrophobic layer, which is adapted to be directed toward the sole of the foot of the user,
- an intermediate hydrophobic layer, preferential passages 19 for water vapor being provided therein and being extended substantially along its main longitudinal direction, in order to convey water vapor introduced in said intermediate layer through said upper layer and guide it toward the perimetric edge 16*a*,
- a hydrophilic lower layer, which is adapted to distribute onto itself the perspiration that arrives from the sole of the foot of the user and has permeated through said upper and intermediate layers.

Advantageously, the preferential passages 19 are substantially transverse to the direction of longitudinal extension of the shoe 10, said intermediate layer being provided with ribs 20 which are transverse to said longitudinal direction so as to define between them the preferential passages 19.

Advantageously, said upper layer has a structure with strips of fabric that cover the crests 21 of the ribs 20.

Conveniently, said lower layer is made of fibers of a material selected from cotton, linen, cellulose, synthetic materials or other equivalent fibers.

In particular, in a preferred solution said lower layer is made of fibers of polyamide, such as for example modified nylon 6 or nylon 66.

Said intermediate layer is conveniently interwoven with said upper layer and with said lower layer, so as to define the ribs 20.

The ribs 20, conveniently, have a thickness of not less than 2 millimeters and preferably comprised between 3 and 4 millimeters.

Moreover, said upper layer with strips advantageously has a width of said strips that is substantially not less than 2 mm and not more than 6 mm, preferably a width of approximately 4 mm.

The preferential passages 19 conveniently have a medium width, defined by the interspace between two successive ribs 20, substantially comprised between 3 mm and 8 mm and preferably equal to 4 mm.

Figure 2A:
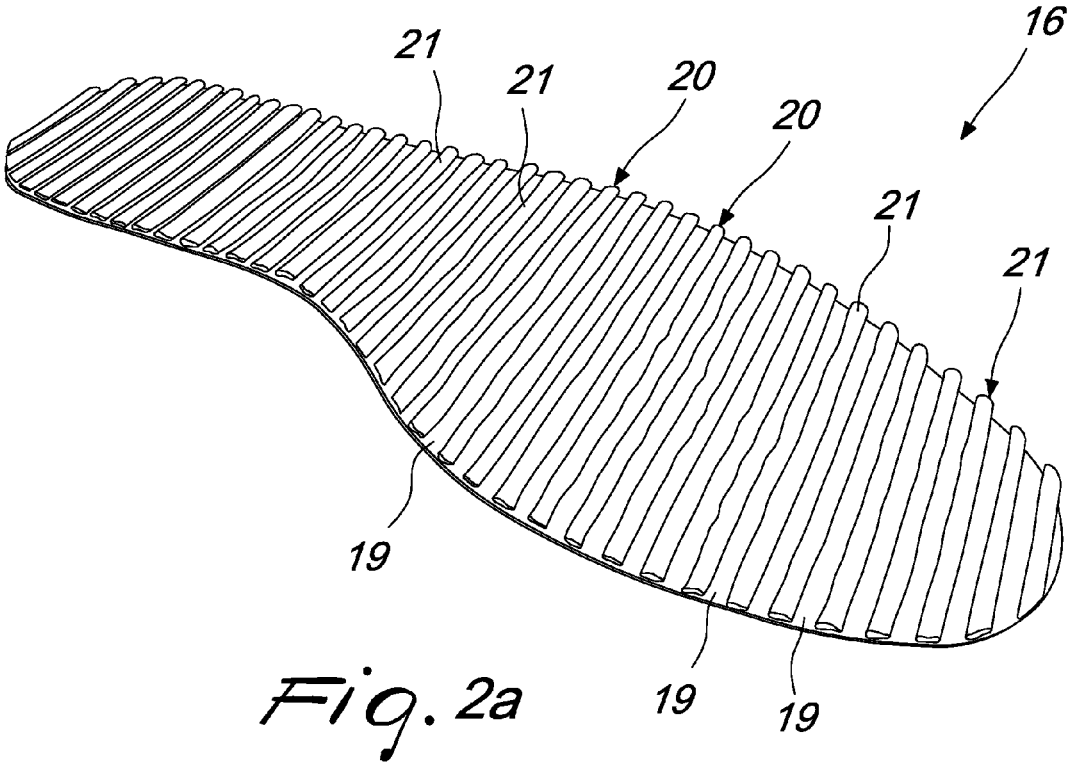
Figure 2B:
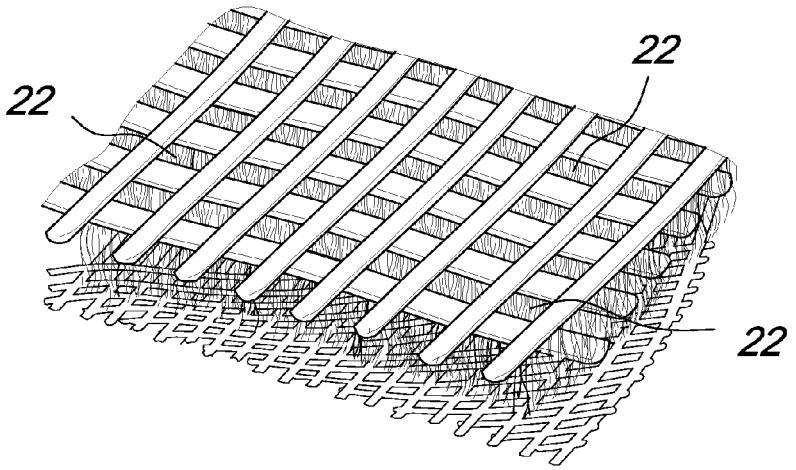

Depending on the contingent requirements of execution of a vapor permeation layer according to the invention, illustrated by way of non-limiting example in FIG. 2*b*, as an alternative said upper layer has a structure with finely perforated continuous fabric 22.

In this case, said intermediate layer also is made of finely perforated fabric and is corrugated so as to provide said ribs.

Figure 2C:
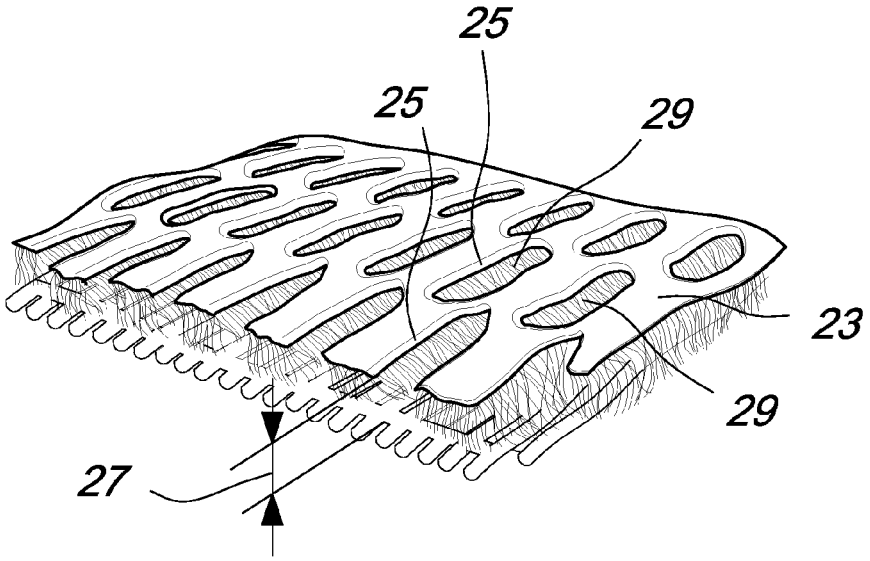
Figure 2D:
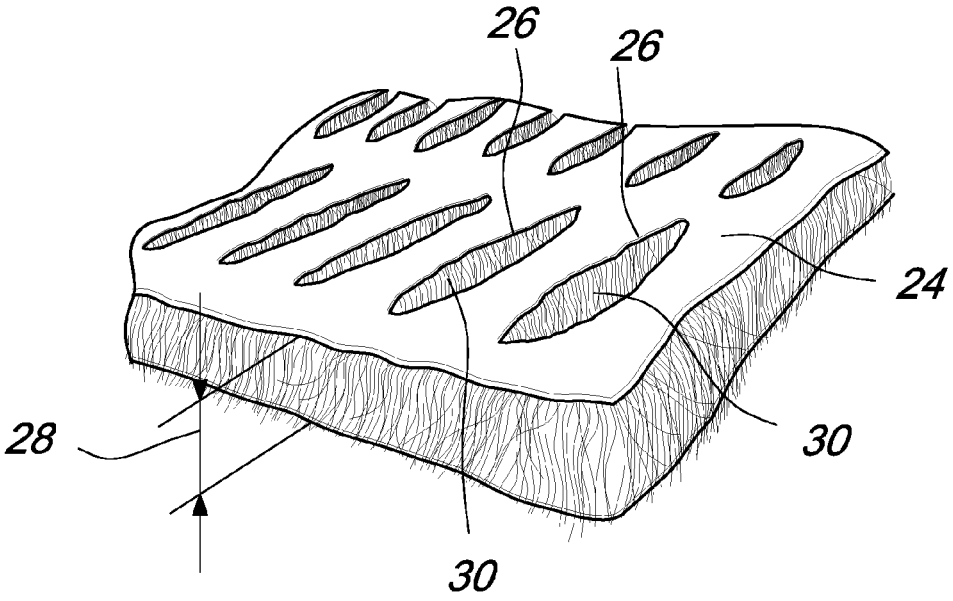

As an alternative, in additional embodiments of the invention, depending on the contingent requirements, said upper layer is conveniently constituted by a fabric that has diffuse macroperforations, as shown by way of non-limiting example in FIGS. 2*c* and 2*d*, where said upper layer is designated by the reference numerals 23 and 24 and the respective macroperforations are designated by the reference numerals 25 and 26.

In this case, said intermediate layer, respectively designated by the reference numerals 27 and 28, conveniently has spaces, respectively 29 and 30, at the macroperforations 25 or 26, said preferential passages being defined by the succession of said spaces along the main longitudinal direction of said intermediate layer.

Advantageously, the openings 17 are provided at the lower edge 31 of the upper 12; said edge, at the openings 17, comprises protective inserts 32, which are permeable at least to water vapor and are adapted to contrast the penetration of objects into the shoe 10 through the openings 17.

The protective inserts 32 preferably replace the body 12*a* of the upper 12 at the openings 17, the functional element 18 facing the protective inserts 32.

In an alternative embodiment of the invention, not shown in the accompanying figures, there is conveniently just one of said protective inserts, which replaces the body of the upper at substantially the whole perimeter of the connection of the upper assembly to the tread portion.

In alternative variations not shown in the accompanying figures, the openings and the protective inserts that replace therein the body of the upper are advantageously concealed esthetically by welts or bands which are perforated or in any case vapor permeable and are connected to the tread portion.

The protective inserts 32 conveniently have, depending on the contingent requirements of execution, a structure selectively among structures of the net-like type or made of knitted, woven or three-dimensional fabric.

In particular, the protective inserts 32 are preferably made of monofilament fibers so as to contrast the wicking of water through them.

The protective inserts 32 are conveniently shaped like a band and have a width substantially comprised between 20 mm and 40 mm; moreover, they comprise in particular a central portion and lateral strips, said lateral strips being elastically extensible and at least partially elastically deformable and deformed so as to adapt the longitudinal extension of the protective inserts 32 to the shape of the tread portion 15 and of the upper 12, where the protective inserts 32 replace the body 12*a* of the upper 12 at the openings 17.

Said central portion conveniently has a structure selected among a transverse fiber structure, a net structure, a knitted fabric structure, a woven fabric structure, a three-dimensional fabric structure.

A first one of said lateral strips is joined conveniently to the body 12*a* of the upper 12, the second one of said lateral strips being joined to the tread portion 15.

Thus, the protective inserts 32 are curved, extending in a differential manner said lateral strips so as to keep substantially without undulations or wrinkles the lower edge 31 of the upper 12 that comprises them, particularly in the regions of the toe and the heel of the shoe 10, where the lower edge 31 has the greatest curvature.

This allows to improve the aesthetics of the portion of the lower edge 31 that comprises the protective inserts 32, or that is formed by them, and remains exposed above the feather line between the upper 12 and the tread portion 15.

Advantageously, the functional layer 13 and the functional element 18 are made of waterproof and vapor-permeable polymeric material, selected conveniently among expanded polytetrafluoroethylene, e-PTFE, polyurethane, PU, and similar materials.

The functional element 18 is conveniently joined to the inner surface of the lower edge 31 of the upper 12 and to the inner surface of the protective inserts 32, conveniently so as to not compromise the vapor permeation thereof, therefore for example by gluing with spots of adhesive or by hot pressing, in a per se known manner.

The functional element 18 is preferably sealed to the outer surface of the functional layer 13, advantageously by gluing or high-frequency welding, so as to form a first sealing region, which is designated in the accompanying figures by a segment in broken lines and by the reference letter B.

The lower edge 31 of the upper 12 and the functional element 18 that is joined thereto at the openings 17 so as to seal them in a waterproof and vapor-permeable manner are conveniently folded back, according to the working method known as "AGO lasting", below an assembly insole 33 advantageously made of waterproof material adapted to provide a seal against water and provided below the vapor permeation layer 16, said functional element 18 being glued so as to form a waterproof seal below the insole 33.

According to the contingent requirements, in alternative embodiments of the shoe the insole conveniently is made of non-waterproof material or advantageously is made of waterproof material adapted to provide a seal against water but permeable to vapor or perforated in the region adapted for vapor circulation.

Preferably, the functional layer 13 has its face directed toward the outside of the foot insertion space A covered by a supporting mesh, for example made of nylon, in a manner per se known, not shown in the accompanying figures.

The functional layer 13 is advantageously associated with the lining 14 by adhesion by lamination with spots of glue so as to not compromise the vapor permeability of the laminate; the upper 12 instead is not associated with the functional layer 13 or is associated only locally.

Conveniently, the functional layer 13 comprises at least one plantar portion 13*a* and at least one lateral portion 13*b* joined thereto so as to form a sock that encloses the foot insertion space A.

Accordingly, the lining 14 conveniently comprises at least one lower portion 14*a* and at least one lateral portion 14*b*, which is joined thereto so as to cover the functional layer 13 inside the foot insertion space A.

Depending on the contingent requirements, the lower portion 14*a* and the lateral portion 14*b* of the lining 14 can be made of different materials.

The connections between the lateral portion 13*b* and the plantar portion 13*a* of the functional layer 13 are conveniently provided by sewing and are sealed by means of a thermo-adhesive waterproof tape or by means of a waterproofing adhesive, for example of the UPACO type, in a manner per se known and not shown in the accompanying figures.

In alternative variations, the functional layer is conveniently associated with the upper, so as to not compromise its vapor permeation, for example by spot gluing or by hot pressing, in a manner known per se; the lining instead is not associated with the functional layer or is associated only locally.

In alternative embodiments of the invention, not described or illustrated further, according to the contingent requirements, the protective inserts, joined to the functional element, are conveniently connected to the edge of the insole by sewing.

The tread portion 15 is joined to the upper assembly 11 advantageously by gluing, according to the working method known as "cemented", or, depending on the contingent requirements, by molding, according to the working method known as "injected".

The functional element 18 is sealed to the upper surface of the tread portion 15 and to the lower surface of the insole 33, advantageously made of waterproof material adapted to provide a seal against the water, conveniently by means of gluing by sealing material, in the case of "cemented" working method.

As an alternative, in the case of the "injected" working method, the functional element 18 is sealed to the upper surface of the tread portion 15 advantageously by co-molding, on the upper assembly 11, the polymeric material for forming the tread portion 15 or one of its upper layers for connecting to the upper assembly 11 such as for example a mid-sole.

In this case, conveniently the material that forms the tread portion 15, or one of its upper layers, permeates the protective inserts 32, leaving free a portion 32*a* thereof that faces the perimetric edge 16*a* of the vapor permeation layer 16; said material, permeated through the protective inserts 32, is conveniently gripped so as to form a waterproof seal to the functional element 18, so as to define a second sealing region, designated in the accompanying figures by a segment in broken lines and by the reference letter C.

The waterproof sealing of the functional element 18 to the functional layer 13 and the waterproof sealing of the tread portion 15 to the insole 33 and to the functional element 18 are of fundamental importance in order to avoid infiltrations of water, which arrive from the environment outside the shoe 10, through the upper 12 and the openings 17 and in order to protect from humidity the foot insertion space A inside the shoe 10.

Thanks to the provision of the sealing regions B and C, in fact, dirty water is unable to reach the vapor permeation layer 16 and any other components provided below the foot insertion space A, depending on the contingent requirements of execution of the invention.

Thus, according to the invention, the tread portion 15 is sealed to the function layer 13 in a waterproof and vapor-permeable manner at the openings 17 by means of the functional element 18 that is sealed to them and provides a sealing bridge between them.

More particularly, in the manufacture of the shoe 10 according to the working method known as "AGO lasting", conveniently the lower edge 31 of the upper 12 and the protective inserts 32 joined to the functional element 18, which it comprises, are folded back and glued below the perimetric edge 33*a* of the insole 33 by means of a lasting operation conveniently without the use of nails or staples that might damage the functional element 18 and the functional layer 13.

This lasting operation is performed conveniently with a machine known as toe lasting machine, the lasting pliers of which have been flattened, i.e., have been stripped of the clamping teeth or millings, so as not to tear the functional element 18.

A particular functionality of the insole 33 is that it preserves the plantar portion 13*a* of the functional layer 13 from possible tearing by the foot of the toe lasting machine, during the steps of lasting of the upper assembly 11.

In this case, the joining between the functional element 18 and the insole 33 is conveniently provided so as to form a waterproof seal conveniently by means of using an adhesive commonly used in lasting operations, such as for example of the polyurethane type or equivalent, in any case capable of ensuring an effective waterproof seal between the insole and the functional element 18.

Advantageously, an element for reinforcing the functional element 18 is provided, not shown in the accompanying figures, which is adapted to prevent the lasting pliers from tearing it in the lasting operation.

Said reinforcement element advantageously comprises a waterproof thermo-adhesive tape, which is preferably elastic and made of synthetic material such as for example polyurethane, PU.

A non-limiting example of said reinforcement element consists of a tape made of polyurethane with a weight substantially comprised between 110 g/m$^2$ and 240 g/m$^2$, currently proposed by the firm TecnoGl.

In a second and alternative method of execution of the invention, not shown in the accompanying figures, the functional element and the protective inserts are joined to the edge of the insole preferably by a sewing, conveniently of the Strobel type, or, in a substantially equivalent manner by means of a sewing of the type known as "pinching".

Advantageously, in the case of the working method of the "injected" type, the tread portion 15 is formed in one piece directly on the upper assembly 11 associated with the insole 33, by injection molding or by pouring polymeric material, preferably selected from thermoplastic material or polyurethane.

In this case, a further functionality of the insole 33 advantageously consists in preserving the breathability of the vapor permeation layer 16 by shielding it from the material that forms the tread portion 15 during the molding thereof.

In particular, the polymeric material that constitutes the tread portion 15 is conveniently injected or poured in a mold, so that it grips so as to form a waterproof seal the functional element 18, passing through the protective inserts 32, leaving free the portion 32*a* that faces the perimetric edge 16*a*.

In constructive variations that are not further described or illustrated in the accompanying figures, the tread portion can comprise multiple parts, such as for example a mid-sole, for example made of polyurethane, and a lower layer that acts as tread, for example made of rubber.

In this case, the material that forms said mid-sole is conveniently injected onto the upper assembly associated with the insole and the tread is conveniently co-molded onto the mid-sole or is glued thereto.

In the case of the working method of the "cemented" type, the sealing material is conveniently spread on the protective inserts 32, permeating them until it grips the functional element 18, leaving free the portion 32*a* thereof that faces the perimetric edge 16*a*, and on the region of the insole 33, made advantageously of waterproof material adapted to provide a seal against water, that is adjacent to the protective inserts 32.

Then the tread portion 15 is joined to the upper assembly 11 connected to the insole 33 to provide mutual joining with a waterproof seal.

Conveniently, said sealing material is selected from silicone adhesives, thermoplastic adhesives, polyurethane hot-melt reactive adhesives, such as for example the adhesive currently known by the trade name IPATHERM S 14/176, manufactured by the firm H.B. Fuller or equivalents, latex or polyurethane.

Figure 3:
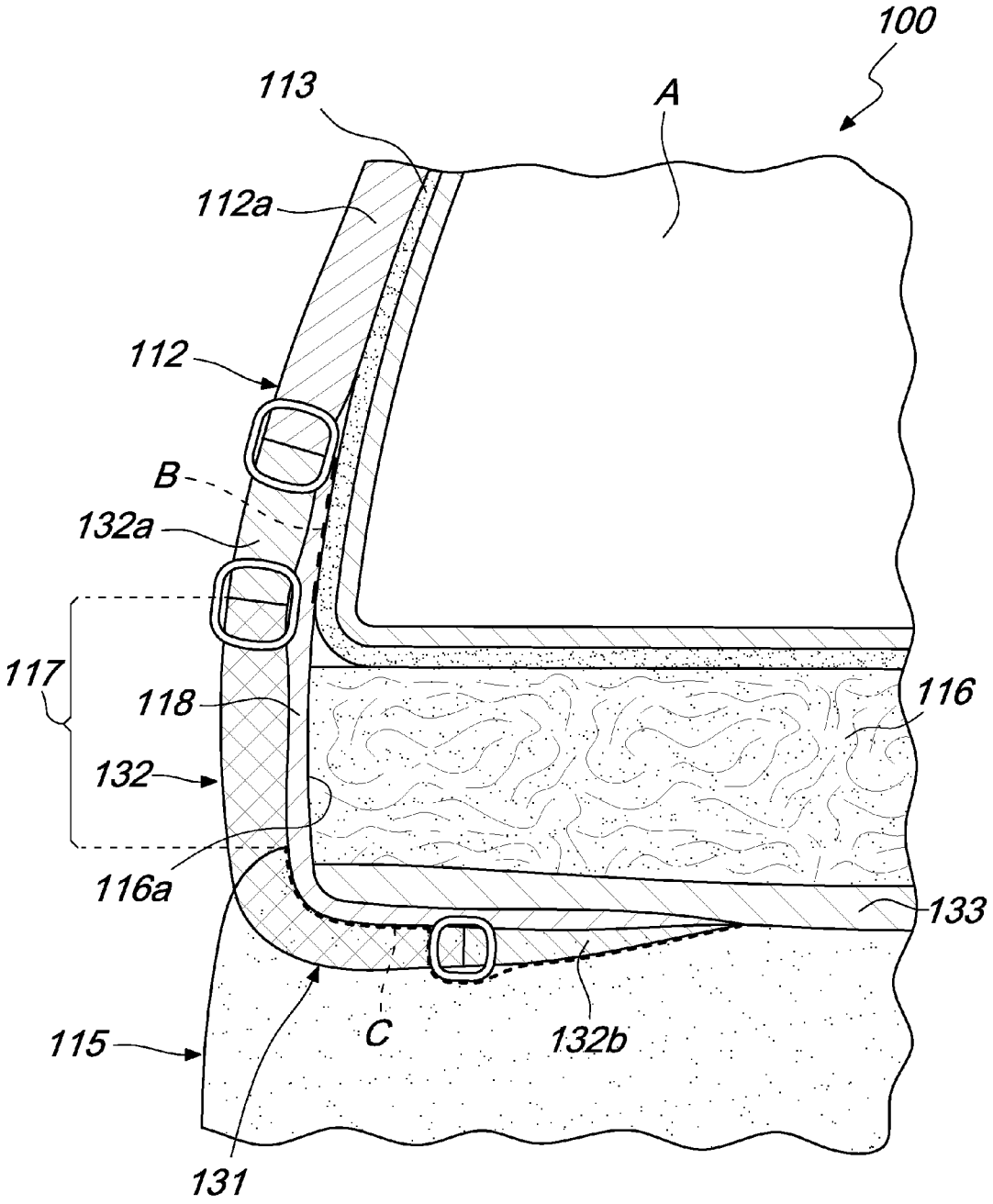
FIG. 3 is an enlarged-scale sectional view of a detail of a shoe according to the invention, in a first alternative embodiment.

A first alternative embodiment of a shoe according to the invention, illustrated by way of non-limiting example in FIG. 3, where it is generally designated by the reference numeral 100, differs from the previous one described so far substantially in that the protective inserts, now designated by the reference numeral 132, are provided with lateral tapes 132*a* and 132*b* made of polymeric material, which define the lateral flaps thereof and are adapted for the connection of the protective inserts 132 to the body 112*a* of the upper 112 and to the tread portion 115.

Conveniently, the lateral tapes 132*a* and 132*b* are associated so as to form a waterproof seal with the functional element 118.

The lateral tapes 132*a* and 132*b* conveniently are made for example of polyvinyl chloride, PVC, or of thermoplastic polyurethane, TPU, and conveniently sewn to the protective inserts 132.

In particular, the first lateral tapes 132*a* are preferably sewn to the edge of the body 112*a* of the upper 112 and the second lateral tapes 132*b* are joined, conveniently by gluing, to the functional element 118.

The lateral tapes 132*a* and 132*b* make it easy to provide the waterproof sealing connection of the protective inserts 132 to the functional element 118, since they can be easily glued or high-frequency welded to the outer surface of the functional element 118, so as to provide respectively a first sealing region B with the outer face of the functional layer 113 and a second sealing region C with the upper face of the tread portion 115.

Thus, according to the invention, the tread portion 115 is sealed to the functional layer 113 in a waterproof and vapor-permeable manner at said openings 117 by means of the functional element 118 that is sealed thereto and provides a sealing bridge between them.

In the present embodiment also, conveniently the lower edge 131 of the upper 112 and the functional element 118, which is joined thereto at the openings 117 so as to seal them in a waterproof and vapor-permeable manner, are folded back, according to the working method known as "AGO lasting", below an insole 133 made advantageously of waterproof material adapted to provide a seal against water, which is provided below the vapor permeation layer 116, the functional element 118 being glued so as to form a waterproof seal below the insole 133.

The material that forms the tread portion 115, or one of its upper layers, permeates the protective inserts 132, leaving free at least one portion thereof that faces the perimetric edge 116*a* of the vapor permeation layer 116, the material permeated through the protective inserts 132 being gripped so as to form a waterproof seal to the functional element 118.

In a variation of said first alternative embodiment, not shown in the accompanying figures, the upper and the functional element that is joined to it at the openings, so as to seal them in a waterproof and vapor-permeable manner, advantageously are sewn at their ends, according to the working method per se known as Strobel, to the perimetric edge of an insole provided below the vapor permeation layer.

Conveniently, the material that forms the tread portion, or one of its upper layers, permeates the protective inserts, leaving free at least one portion thereof that faces the perimetric edge of the vapor permeation layer; the material permeated through the protective inserts is gripped so as to form a waterproof seal to the functional element.

Figure 4:
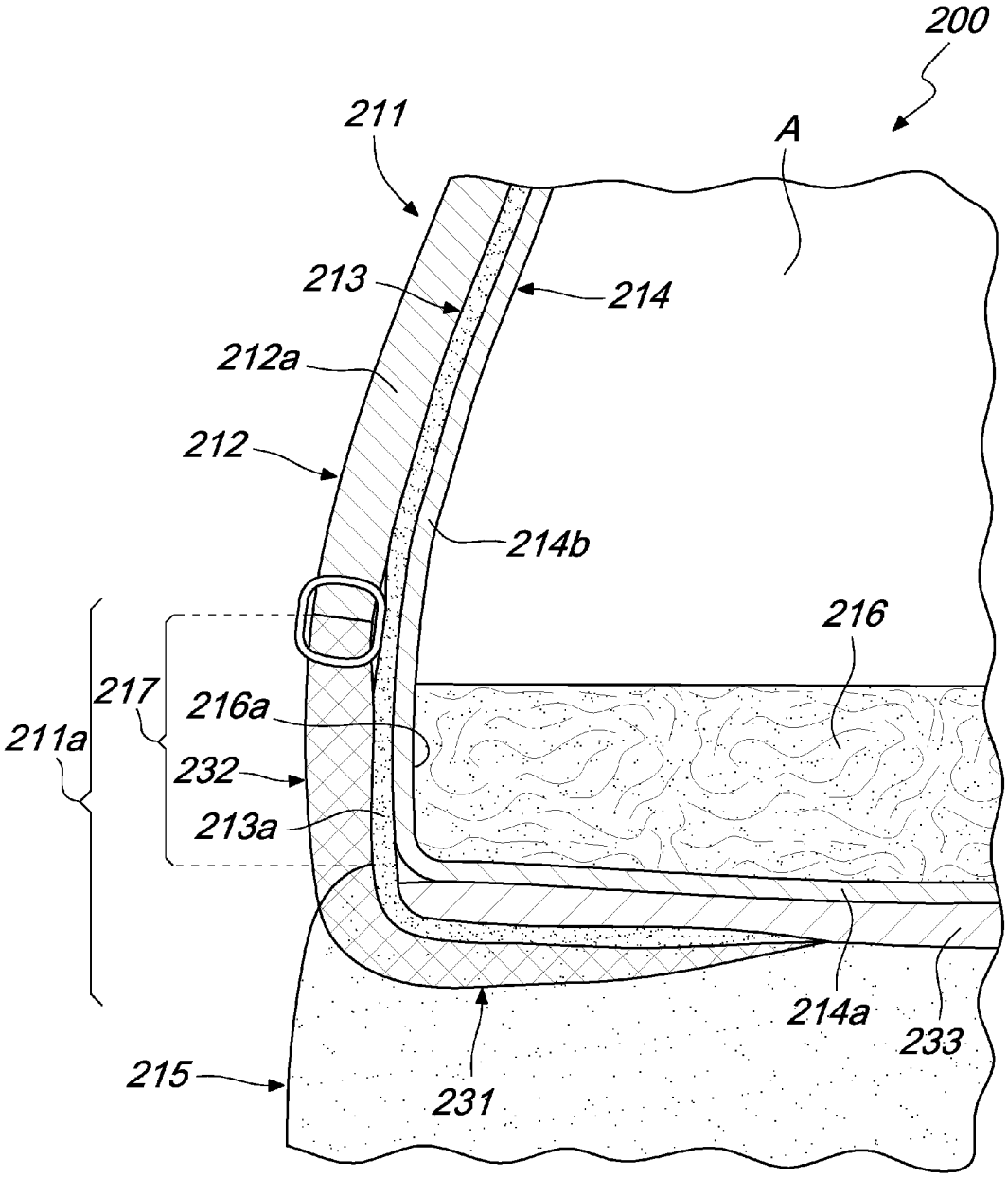
FIG. 4 is an enlarged-scale sectional view of a detail of a shoe according to the invention, in a second alternative embodiment.

A second alternative embodiment of a shoe according to the invention, illustrated by way of non-limiting example in FIG. 4, where it is generally designated by the reference numeral 200, differs from the previous ones described so far substantially in that the role played by the functional element described so far is played, in a substantially equivalent manner, by at least one functional portion 213*a* of the functional layer 213.

Thus, according to the invention, the functional portion 213*a* is interposed between the perimetric edge 216*a* and the openings 217 in order to prevent the access to the vapor permeation layer 216 of water that arrives from the openings 217.

The tread portion 215 is conveniently sealed to the functional layer 213 by means of the functional portion 213*a*, providing between them a sealing bridge that is waterproof and vapor-permeable at the openings 217.

Advantageously, the functional portion 213*a* of the functional layer 213 constitutes the edge thereof, since the functional layer 213 is joined in a vapor-permeable manner to the upper 212.

The lower edge of the upper 212 and the functional portion 213*a*, which is joined thereto at the openings 217 so as to seal them in a waterproof and vapor-permeable manner, are conveniently folded back, according to the working method known as "AGO lasting", under an insole 233, which is made advantageously of waterproof material adapted to provide a seal against water, provided below the vapor permeation layer 216, the functional portion 213*a* being glued so as to provide a waterproof seal below the insole 233.

Advantageously, the material that forms the tread portion 215, or at least one of its upper layers, permeates the protective inserts 232, leaving free at least one portion thereof that faces the perimetric edge 216*a* of the vapor permeation layer 216, the material permeated through the protective inserts 232 being gripped so as to form a waterproof seal to the functional portion 213*a*.

Moreover, advantageously, the lining 214 is closed like a sock and accommodates internally the vapor permeation layer 216, its lower portion 214*a* being thus juxtaposed to the upper face of the insole 233, and the lateral portion 214*b* that is interposed between the functional portion 213*a*, and the perimetric edge 216*a* of the vapor permeation layer 216.

Conveniently, the functional layer 213 is appropriately associated with the body 212*a* of the upper 212 and with the protective inserts 232, so as not to compromise vapor permeation, for example by hot pressing spot gluing, in a per se known manner.

Instead, the lining 214 conveniently is not associated with the functional layer 213 or is associated only locally.

In particular, the functional portion 213*a* of the functional layer 213 is joined to the protective inserts 232 preferably by gluing or sewing along the lower edge of the functional layer 213.

In general, the lower margin 211*a* of the upper assembly 211, which comprises the lower edge 231 of the upper 212 and the protective inserts 232, which are part of the lower edge 231, joined to the functional layer 213, is advantageously associated with the insole 233, according to the contingent requirements, by sewing or by means of the working method known as "AGO lasting".

In particular, in the case of the "AGO lasting" working method, conveniently there is a reinforcement element for the functional layer 213, not shown in the accompanying figures, which is adapted to prevent the lasting pliers from tearing it during the lasting operation.

Said reinforcement element advantageously comprises a waterproof thermo-adhesive tape, which is preferably elastic, made of synthetic material, for example polyurethane, PU, such as for example the tape with a weight substantially comprised between 110 g/m$^2$ and 240 g/m$^2$ currently proposed by the firm TecnoGi.

Figure 5:
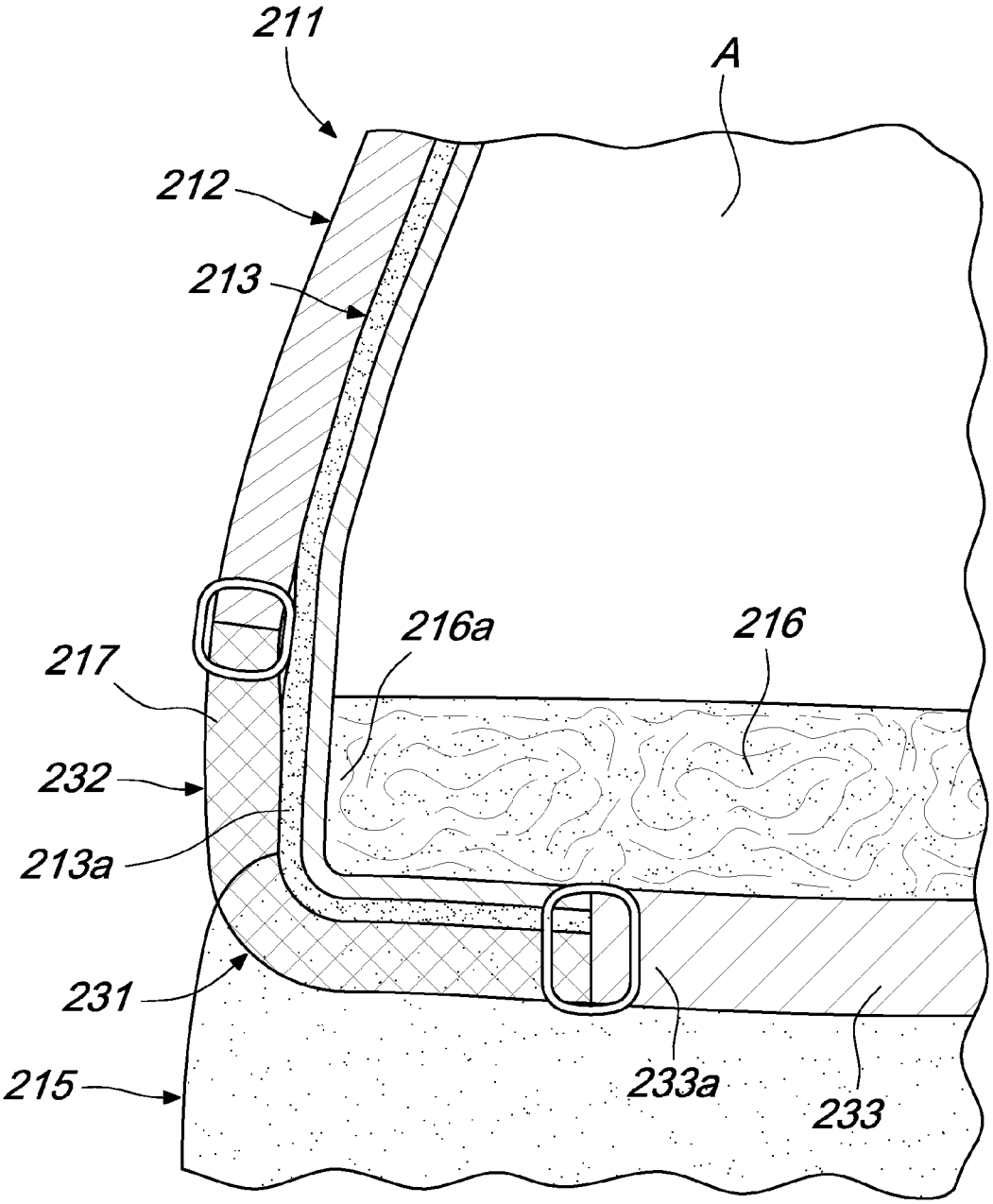
FIG. 5 is an enlarged-scale sectional view of a detail of a shoe according to the invention, in a variation of said second alternative embodiment.

In a constructive variation of the present embodiment of the invention, illustrated by way of non-limiting example in FIG. 5, the lower edge 231 of the upper 212 and the functional portion 213*a* that is joined thereto at the openings 217 so as to seal them in a waterproof and vapor-permeable manner are sewn at their ends, conveniently by sewing of the Strobel type, or, in a substantially equivalent manner, by sewing of the type known as "pinching", to the perimetric margin 233*a* of an insole 233 provided below the vapor permeation layer 216.

In this case also, advantageously, the material that forms the tread portion 215 or one of its upper layers permeates the protective inserts 232, leaving free at least one portion thereof that faces the perimetric edge 216*a* of the vapor permeation layer 216, the material permeated through the protective inserts 232 being gripped so as to form a waterproof seal to the functional portion 213*a* that lines them internally.

The joining of the tread portion 215 to the upper assembly 211 joined to the insole 233 advantageously is provided by gluing, according to the working method known as "cemented", or as an alternative by molding, according to the working method known as "injected", according to the contingent requirements.

Thus, the waterproof seal of the foot insertion space A is obtained by means of the waterproof sealing connection provided

- in the case of the working method of the "AGO lasting" type, by gluing so as to provide a seal the functional portion 213*a* of the functional layer 213 to the insole 233 and to the upper face of the tread portion 215 by gluing so as to provide a seal in the "cemented" working method, or as an alternative by gripping so as to provide a waterproof seal the material that forms the tread portion 215, or one of its upper parts, in the case of the "injected" working method, or
- in the case of manufacture by sewing, this waterproof sealing connection is provided by sealing material that forms a sealing bridge between the perimetric margin 233*a* of the insole 233 and the functional portion 213*a* of the functional layer 213 that it reaches, permeating the protective inserts 232, said sealing material being a glue in the case of the "cemented" working method, or the material that forms the tread portion 215, or of one of its upper parts, in the case of the "injected" working method.

In a preferred variation of said second embodiment, there is just one of the protective inserts that replaces the body of the upper, constituting its lower edge completely.

Correspondingly, in this case, the edge of the functional layer seals in a waterproof and vapor-permeable manner said protective insert, acting as a functional element in a manner that is substantially equivalent to the one described in the previous embodiments.

Figure 6:
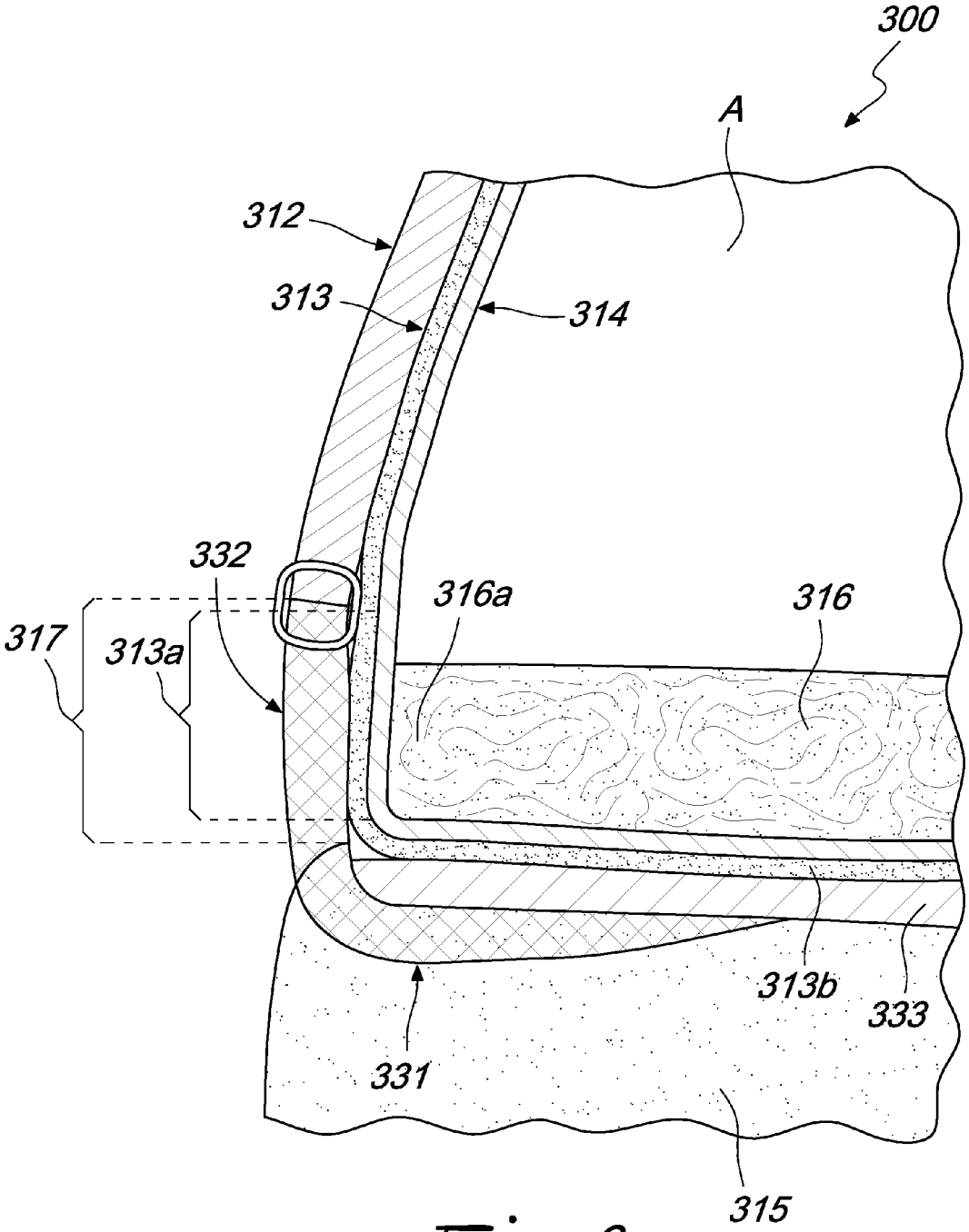
FIG. 6 is an enlarged-scale sectional view of a detail of a shoe according to the invention, in a third alternative embodiment.

A third alternative embodiment of a shoe according the invention, illustrated by way of non-limiting example in FIG. 6, where it is designated generally by the reference numeral 300, differs partially from the previous ones described so far substantially in that the role played by the functional element described so far is played, in a substantially equivalent manner, by at least one functional portion 313*a* of the functional layer 313.

Thus, according to the invention, the functional portion 313*a* is interposed between the perimetric edge 316*a* and the openings 317 so as to prevent the access to the vapor permeation layer 316 of water that arrives from the openings 317.

The tread portion 315 is conveniently sealed to the functional layer 313 by means of the functional portion 313*a*, so as to provide between them a sealing bridge that is waterproof and vapor-permeable at the openings 317.

Advantageously, the functional layer 313 is shaped like a sock so as to enclose the foot insertion space A, where it accommodates the vapor permeation layer 316, said at least one functional portion 313*a* being constituted by a lateral strip of the functional layer 313 that is joined in a vapor-permeable manner to the upper 312.

The lower edge 331 of the upper 312 is conveniently folded back and glued, according to the working method known as "AGO lasting", under an insole 333, which is sealed perimetrically to the lower face of a plantar portion 313*b* of the functional layer 313.

Conveniently, the material that forms the tread portion 315, or one of its upper layers, permeates the protective inserts 332, leaving free at least one portion thereof that faces the perimetric edge 316*a* of the vapor permeation layer 316.

In a variation of the present embodiment of the invention, not shown in the accompanying figures, the lower edge of the upper is conveniently sewn at its end to the perimetric margin of an insole provided below the vapor permeation layer, for example according to the working method per se known as Strobel.

Preferably, the material that forms the tread portion, or of one of its upper layers, permeates the protective inserts, leaving free at least a portion thereof which faces the perimetric edge of the vapor permeation layer, the material permeated through the protective inserts being gripped so as to form a waterproof seal to the peripheral region of the plantar portion of the functional layer.

Advantageously, the functional layer 313 is covered inside the foot insertion space A by a lining 314 that encloses it, where it advantageously accommodates the vapor permeation layer 316.

The functional layer 313 is advantageously associated with the lining 314 by adhesion by lamination with spot gluing so as to not compromise its permeability to vapor; the upper 312 instead is not associated with the functional layer 313 or is associated only locally therewith.

Figure 7:
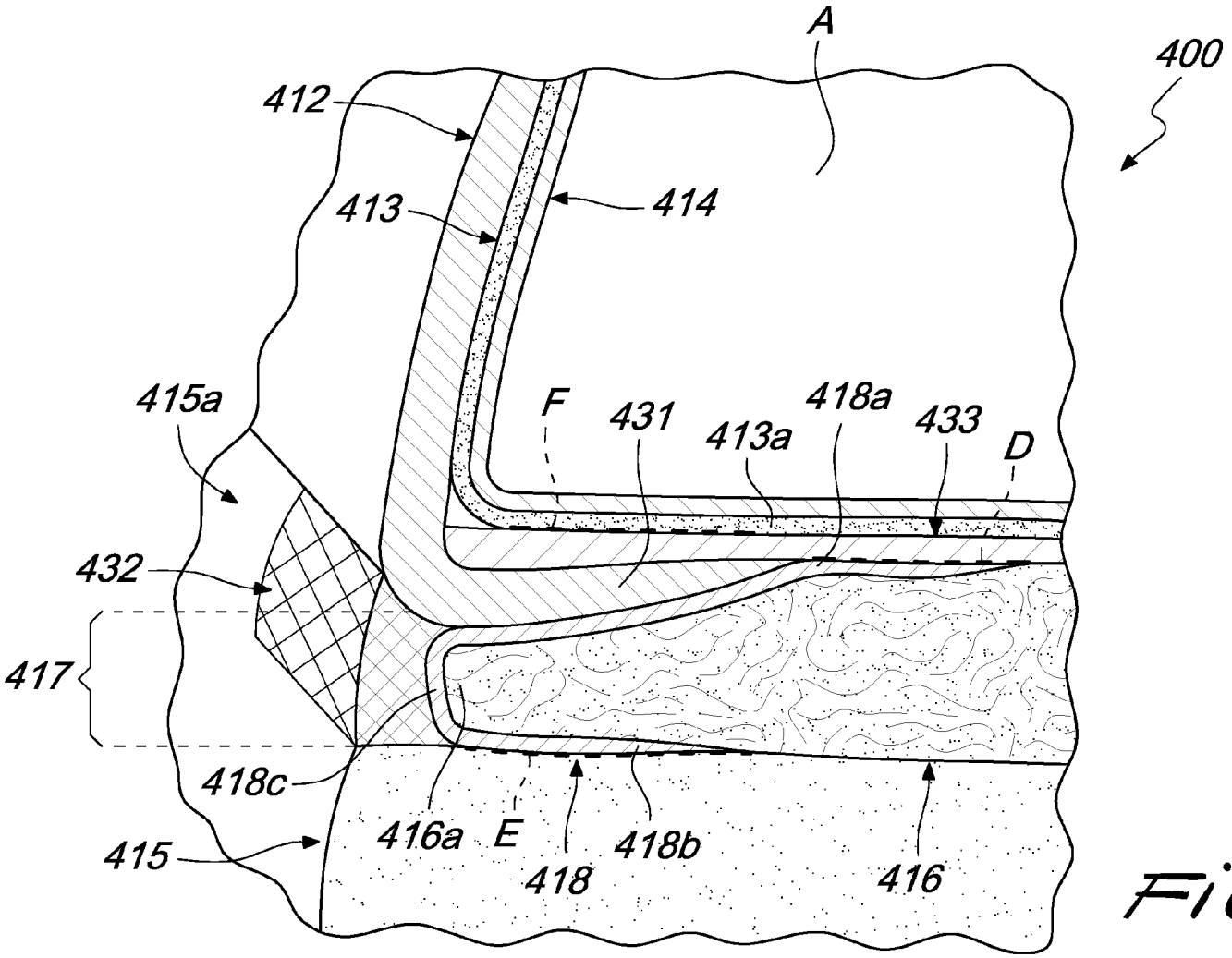
FIG. 7 is an enlarged-scale sectional view of a detail of a shoe according to the invention, in a fourth alternative embodiment.

A fourth alternative embodiment of a shoe according to the invention, illustrated by way of non-limiting example in FIG. 7, where it is designated generally by the reference numeral 400, differs partially from the previous ones described so far substantially in that the openings, designated here by the reference numeral 417, are provided at the upper edge 415*a* of the tread portion 415, which, at the openings 417, comprises protective inserts 432 that are permeable at least to water vapor and are adapted to contrast the penetration of objects into the shoe 400 through the openings 417.

The protective inserts 432 conveniently replace the body of the upper edge 415*a* at the openings 417, the functional element 418 facing the protective inserts 432.

The lower edge 431 of the upper 412 is conveniently folded back and glued, according to the working method known as "AGO lasting", under the provided insole 433, conveniently made of waterproof material, adapted to provide a seal against water, and vapor-permeable or perforated in the central portion adapted for the circulation of water vapor, an upper flap 418*a* of the functional element 418 being folded back above the vapor permeation layer 416 and being connected so as to form a waterproof seal below the insole 433, advantageously by sealing gluing or high-frequency welding, so as to form a first seal, illustrated by way of non-limiting example in FIG. 7 by a segment in broken lines designated by the reference letter D.

The lower flap 418*b* of the functional element 418 is advantageously folded back below the vapor permeation layer 416 and is connected to the tread portion 415 so as to form a waterproof seal, advantageously by sealing gluing or high-frequency welding, so as to form a second seal, illustrated by way of non-limiting example in FIG. 7 by a segment in broken lines designated by the reference letter E.

Moreover, the flaps 418*a* and 418*b* are conveniently connected to the vapor permeation layer 416 so as not to compromise its breathability by spot gluing, by hot pressing, in a per se known manner.

A central portion 418*c* of the functional element 418, which is intermediate to the flaps 418*a* and 418*b*, is conveniently interposed between the protective inserts 432 and the perimetric edge 416*a* of the vapor permeation layer 416, which it covers.

Moreover, the functional layer 413 is conveniently shaped like a sock and has a plantar portion 413*a* which is sealed perimetrically in a waterproof manner above the insole 433, so as to form a third seal, illustrated by way of non-limiting example in FIG. 7 by a segment in broken lines designated by the reference letter F.

Thus, the tread portion 415 is sealed to the functional layer 413 by means of a sealing bridge, which is waterproof and vapor-permeable at least at the openings 417, provided by the functional element 418, which is sealed to the tread portion 415 and to the insole 433, which is sealed to the functional layer 413.

Conveniently, there is a lining 414 that covers the functional layer 413 inside the foot insertion space A that they enclose.

Advantageously, the protective inserts 432 are made of a material that is porous and permeable to water vapor and to water, such as for example porous rubber or open-cell expanded polyurethane, which are highly permeable.

In any case, the protective inserts 432 are completely permeable and allow therefore the permeation of water vapor, as well as heat dispersion through them.

In a preferred variation of said fourth embodiment of the invention, advantageously there is just one of said openings, which affects the entire perimeter of the shoe, replacing completely the entire lower edge.

In this case, there is just one of said protective inserts, made of polymeric material permeable at least to water vapor, that surrounds perimetrically, in an annular manner, the vapor permeation layer, which is extended along the entire extension of the sole of the shoe.

Shoes according to the invention are particularly adapted for safety use in work that is particularly exposed to the risk of piercing of the sole of the foot; therefore, conveniently they comprise, inserted in the tread portion, an element made of anti-piercing metallic material arranged so as to not prevent or limit vapor permeation through the lateral openings of the shoe.

As an alternative to an element made of metallic material, it is also possible to use a different material with the same strength characteristics, such as carbon fiber, fiberglass and the like.

In practice it has been found that the invention achieves the intended aim and objects, providing a shoe that allows to overcome the limitations and drawbacks of currently known shoes, particularly allowing to avoid the impregnation of the vapor permeation layer, though maintaining an efficient vapor permeation capacity through it.

A shoe according to the invention, moreover, allows to avoid the impregnation of the vapor permeation layer with water that arrives from outside the shoe, though allowing to have a soft and flexible vapor permeation layer that does not stiffen the structure of the shoe.

The invention thus conceived is susceptible of numerous modifications and variations, all of which are within the scope of the appended claims; moreover, all the details may be replaced with other technically equivalent elements.

For example, in general there is at least one of said vapor permeation layers arranged below the foot insertion space defined inside the shoe in order to accommodate the foot of the user.

Moreover, in general there is at least one of said openings arranged laterally to the shoe, and correspondingly at least one of said protective inserts, that replaces the body of the upper thereat.

Thus, also, in general said shoe has, according to the invention, at least one of said waterproof and vapor-permeable functional elements interposed between the perimetric edge and the opening so as to prevent access to the vapor permeation layer by water that arrives from the opening.

In practice, the materials used, so long as they are compatible with the specific use, as well as the contingent dimensions and shapes, may be any according to requirements and to the state of the art.

The disclosures in Italian Patent Application No. PD2011A000395 from which this application claims priority are incorporated herein by reference.

The invention claimed is:

1. A waterproof and vapor-permeable shoe, comprising:

an upper assembly, which is composed of at least one upper and a waterproof and vapor-permeable functional layer which is internal thereto;

a tread portion made of waterproof material, which is joined to said upper assembly below said upper assembly;

at least one vapor permeation layer provided below a foot insertion space defined inside said shoe to accommodate the foot of a user;

at least one opening which is lateral with respect to said shoe proximate to a region of connection of said upper assembly to said tread portion, said at least one opening being open toward a perimetric edge of said at least one vapor permeation layer; and at least one waterproof and vapor-permeable functional element or at least one functional portion of the functional layer is interposed between said perimetric edge and said at least one opening to prevent access to said at least one vapor permeation layer of water that arrives from said at least one opening, wherein said at least one vapor permeation layer is made of a vapor-permeable material selected among fibrous, porous, or microporous materials, and wherein said tread portion is sealed to said functional layer by a sealing bridge, which is waterproof and vapor-permeable at said at least one opening, provided selectively by said at least one functional element that is sealed to the tread portion, said functional layer and said at least one opening, or by said at least one functional portion which is sealed to said tread portion and is integral with said functional layer.

2. The shoe according to claim 1, wherein said vapor-permeable material is a three-dimensional fabric which includes:

an upper hydrophobic layer, which is adapted to be directed toward the sole of the foot of the user, an intermediate hydrophobic layer, preferential passages for water vapor being provided therein and being extended substantially along a main plane of extension of the intermediate hydrophobic layer, to convey water vapor introduced in said intermediate layer through said upper layer and guide said water vapor toward said perimetric edge, a hydrophilic lower layer, which is adapted to distribute onto itself the perspiration that arrives from the sole of the foot of the user and has permeated through said upper and intermediate layers.

3. The shoe according to claim 2, wherein said preferential passages are substantially transverse to a direction of longitudinal extension of said shoe, said intermediate layer including ribs which are transverse to said longitudinal direction, the ribs defining therebetween said preferential passages.

4. The shoe according to claim 3, wherein said upper hydrophobic layer includes a structure selectively among:

strips of fabric that cover crests of said ribs or finely perforated continuous fabric.

5. The shoe according to claim 2, wherein said upper hydrophobic layer is constituted by a fabric that has diffuse macroperforations, said intermediate layer having spaces at said macroperforations, said preferential passages being defined by said spaces, which follow one another along a main longitudinal extension of said intermediate layer.

6. The shoe according to claim 1, wherein said at least one opening is provided at a lower edge of said upper, said lower edge, at said at least one opening, comprising at least one protective insert, which is permeable at least to water vapor and is adapted to contrast penetration of objects into said shoe through said at least one opening, said at least one protective insert replacing the body of said upper at said opening.

7. The shoe according to claim 6, wherein said at least one protective insert replaces said body of the upper at substantially an entire perimeter of the connection of said upper assembly to said tread portion.

8. The shoe according to claim 6, wherein said at least one protective insert includes a net structure or a structure of knitted, woven, or three-dimensional fabric.

9. The shoe according to claim 6, wherein said at least one protective insert is made of monofilament fibers to contrast wicking of water therein.

10. The shoe according to claim 6, wherein said at least one protective insert is formed as a band with a width between 20 mm and 40 mm, comprising a central portion and lateral strips, said lateral strips being elastically extensible and at least partially elastically deformable and deformed to adapt a longitudinal extension of said at least one protective insert to the shape of said tread portion and of said upper, wherein said at least one protective insert replaces said upper at said at least one opening, a first one of said lateral strips being joined to the body of said upper and the second one of said lateral strips being joined to said tread portion.

11. The shoe according to claim 6, wherein said at least one protective insert includes lateral tapes made of polymeric material which are adapted for connection to the body of said upper and to said tread portion, said lateral tapes being associated to form a waterproof seal with said at least one functional element.

12. The shoe according to claim 6, wherein said lower edge of said upper and said at least one functional element, which is joined thereto at said at least one opening to seal it in a waterproof and vapor-permeable manner, are folded back below an insole provided below said at least one vapor permeation layer, said at least one functional element being glued to form a waterproof seal below said insole.

13. The shoe according to claim 6, wherein said lower edge of said upper and said at least one functional element, that is joined thereto at said at least one opening so as to seal said at least one opening in a waterproof and vapor-permeable manner, are sewn at their end to a perimetric margin of an insole provided below said at least one vapor permeation layer.

14. The shoe according to claim 6, wherein the material that forms at least one upper layer of said tread portion permeates said at least one protective insert, leaving free at least one portion thereof that faces said perimetric edge of said at least one vapor permeation layer, said material permeated through said at least one protective insert being gripped to form a waterproof seal to said at least one functional element.

15. The shoe according to claim 6, wherein said at least one protective insert includes lateral tapes made of polymeric material, which are adapted for connection to the body of said upper and to said tread portion, said lateral tapes being associated to provide a waterproof seal with said at least one functional portion.

16. The shoe according to claim 6, wherein the material that forms at least one upper layer of said tread portion permeates said at least one protective insert, leaving free at least one portion thereof that faces said perimetric edge of said at least one vapor permeation layer, said material permeated through said at least one protective insert being gripped to form a waterproof seal to said at least one functional portion.

17. The shoe according to claim 6, wherein said lower edge of said upper is folded back and glued under an insole, which is sealed perimetrically to a lower face of a plantar portion of said functional layer.

18. The shoe according to claim 6, wherein said lower edge of said upper is sewn at its end to a perimetric margin of an insole provided below said at least one vapor permeation layer.

19. The shoe according to claim 18, wherein the material that forms at least one upper layer of said tread portion permeates said at least one protective insert, leaving free at least one portion thereof that faces said perimetric edge of said at least one vapor permeation layer, said material permeated through said at least one protective insert being gripped to form a waterproof seal to the peripheral region of a plantar portion of said functional layer.

20. The shoe according to claim 1, wherein said at least one functional portion of said functional layer constitutes the edge of said functional layer, said functional layer being joined in a vapor-permeable manner to said upper.

21. The shoe according to claim 1, wherein a lower edge of said upper and said at least one functional portion, that is joined thereto at said at least one opening to seal said at least one opening in a waterproof and vapor-permeable manner, are folded back under an insole provided below said at least one vapor permeation layer, said at least one functional portion being glued to provide a waterproof seal below said insole.

22. The shoe according to claim 1, wherein a lower edge of said upper and said at least one functional portion, that is joined thereto at said at least one opening to seal it in a waterproof and vapor-permeable manner, are sewn at their end to a perimetric margin of an insole provided below said at least one vapor permeation layer.

23. The shoe according to claim 1, wherein said functional layer is shaped to enclose the foot insertion space where it accommodates said vapor permeation layer, said at least one functional portion being constituted by a lateral strip of said functional layer which is joined in a vapor-permeable manner to said upper.

24. The shoe according to claim 23, wherein the material that forms at least one upper layer of said tread portion permeates at least one protective insert, leaving free at least one portion thereof which faces said perimetric edge of said at least one vapor permeation layer, said material permeated through said at least one protective insert being gripped to form a waterproof seal to an insole.

25. The shoe according to claim 1, wherein said at least one opening is provided at an upper edge of said tread portion, said upper edge, at said at least one opening, comprising at least one protective insert, which is permeable at least to water vapor and is adapted to contrast the penetration of objects into said shoe through said at least one opening, said at least one protective insert replacing the body of said upper edge at said opening and said at least one functional element facing said at least one protective insert.

26. The shoe according to claim 25, wherein an upper flap of said at least one functional element is folded back above said at least one vapor permeation layer and is connected to form a waterproof seal below a waterproof and vapor-permeable insole, and a lower flap of said at least one functional element is folded back below said at least one vapor permeation layer and is connected to said tread portion to form a waterproof seal.

27. The shoe according to claim 26, wherein said functional layer is shaped to enclose the foot insertion space and has a plantar portion which is sealed perimetrically in a waterproof manner above said insole.

* * * * *